United States Patent [19]

Buell

[11] Patent Number: 4,891,673

[45] Date of Patent: Jan. 2, 1990

[54] DEVELOPMENT SYSTEM

[75] Inventor: Kim S. Buell, Sodus, N.Y.

[73] Assignee: Xerox Corporation, Stamford, N.Y.

[21] Appl. No.: 229,072

[22] Filed: Aug. 4, 1988

[51] Int. Cl.[4] ..... G03G 15/09

[52] U.S. Cl. ..... 355/245; 355/251; 118/657

[58] Field of Search ..... 355/3 DD, 14 D, 245, 355/251; 118/656–658

[56] References Cited

U.S. PATENT DOCUMENTS

| | | | |
|---|---|---|---|
| 4,101,211 | 7/1978 | Rayson | 355/3 DD |
| 4,387,982 | 6/1983 | Stanley | 355/3 DD |
| 4,394,086 | 7/1983 | Hoffman | 355/3 R |
| 4,614,165 | 9/1986 | Folkins et al. | 118/657 |
| 4,697,914 | 10/1987 | Hauser | 355/3 DD |

*Primary Examiner*—Arthur T. Grimley

*Assistant Examiner*—J. Pendegrass

*Attorney, Agent, or Firm*—H. Fleischer; J. E. Beck; R. Zibelli

[57] ABSTRACT

An apparatus which develops an electrostatic latent image recorded on a photoconductive member used in an electrophotographic printing machine. The apparatus employs a developer material which ages during the life of the electrophotographic printing machine. Carrier granules are added to the developer material to extend the life of the developer material. When the quantity of developer material exceeds a predetermined quantity, developer material exits therefrom through an exit port. A magnetic flux field is generated in the region of the exit port to form a carrier bead curtain which prevents the passage of toner particles therethrough while permitting developer material and carrier granules to exit therefrom.

11 Claims, 2 Drawing Sheets

DEVELOPMENT SYSTEM

Figure 1:
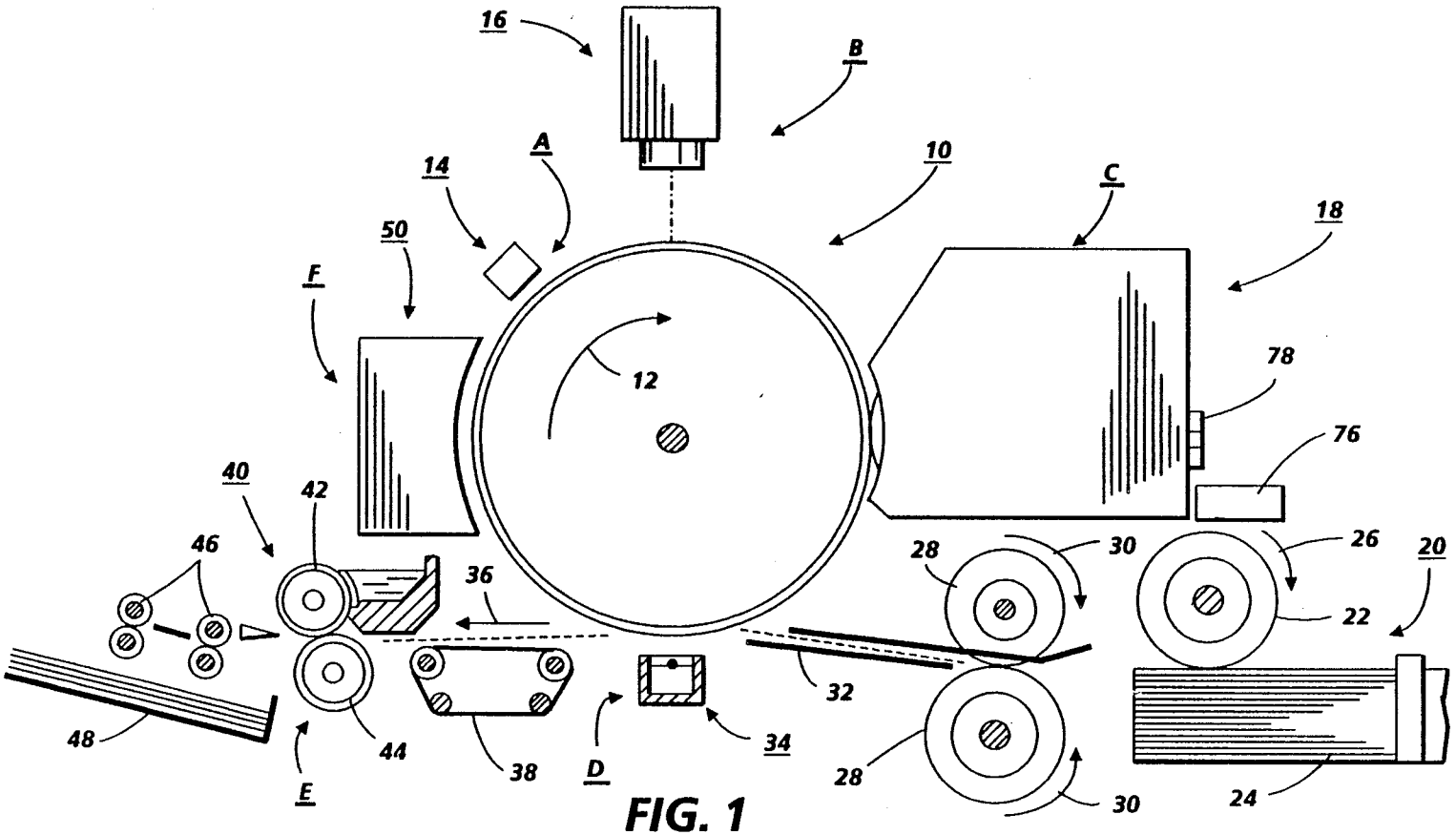

This invention relates generally to an electrophotographic printing machine, and more particularly concerns an apparatus for developing an electrostatic latent image recorded on a photoconductive member used in a printing machine.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. This forms a powder image on the photoconductive member which is subsequently transferred to a copy sheet and permanently affixed thereto in image configuration.

Typically, the developer material comprises toner particles adhering triboelectrically to magnetic carrier granules. This two component mixture is brought into contact with the photoconductive surface. The toner particles are attracted from the carrier granules to the latent image. It is clear that the developer material is a critical component of the printing machine. As the developer material ages and approaches the end of its useful life, copy quality deteriorates. It has been found that by adding additional carrier granules, the life of the developer material can be significantly increased. However, as additional carrier granules are added to the chamber storing the developer material, developer material must be removed therefrom to maintain the developer material therein at the desired quantity. Frequently, airborne toner particles escape through the exit port as well as developer material and denuded carrier granules, i.e. carrier granules without toner particles adhering thereto. The airborne toner particles contaminate the various other subsystems within the printing machine reducing their life and causing copy quality problems. Clearly, it is desirable to prevent the escape of airborne toner particles from the chamber of the developer housing while permitting the removal of developer material and denuded carrier granules therefrom. Various approaches have been devised to achieve the foregoing. The following patents appear to be relevant:

US-A-4,387,982 Patentee: Stanley Issued: June 14, 1983

US-A-4,394,086 Patentee: Hoffman, Jr.et al. Issued: July 19, 1983

US-A-4,614,165 Patentee: Folkins et al. Issued: Sep. 30, 1986

US-A-4,697,914 Patentee: Hauser Issued: Oct. 6, 1987

The pertinent portions of the foregoing patents may be briefly summarized as follows:

US-A-4,387,982 discloses a removable charged particle containment apparatus which is electrically biased to a voltage level different than that of the image voltage recorded on the photoconductive member to repel or attract the charged particles therefrom.

US-A-4,394,086 describes a particle containment apparatus for an electrophotograhic printing machine which controls air flowing into and out of a chamber in a housing to minimize the escape of particles therefrom.

US-A-4,614,165 discloses a development apparatus wherein additional carrier granules are continually added to developer material in the chamber of the developer housing. An exit port is provided to remove the excess developer material so as to maintain the developer material at a predetermined quantity.

US-A-4,697,914 describes a toner containment method and apparatus which creates an electric field barrier in the exit portion of the housing in an electrostatic reproducing machine sufficient to repel the charged particles in the exiting air back into the principal portion of the housing without restricting the air flow from the exit portion.

In accordance with one aspect of the present invention, there is provided an apparatus for developing an electrostatic latent image used in a printing machine. The apparatus includes means for transporting a developer material comprising at least carrier granules having toner particles adhering thereto into contact with the electrostatic latent image. A housing defines a chamber having a supply of developer material therein. The transporting means is in communication with the chamber of the housing for receiving developer material. The housing has an exit port for removing developer material from the chamber when the quantity of developer material therein is greater than a predetermined quantity. Means are provided for discharging toner particles and carrier granules into the chamber of the housing. Means seal the exit port of the housing with a substantially impervious toner particle seal. The sealing means is pervious to developer material and carrier granules so as to prevent the passage of toner particles through the exit port while permitting the passage of developer material and carrier granules therethrough.

Pursuant to another aspect of the present invention, there is provided an electrophotographic printing machine of the type having an electrostatic latent image recorded on a photoconductive member. The printing machine includes means for transporting a developer material comprising at least carrier granules having toner particles adhering thereto closely adjacent to the electrostatic latent image recorded on the photoconductive member. A housing defines a chamber having a supply of developer material therein. The transporting means is in communication with the chamber of the housing for receiving developer material. The housing has an exit port for removing developer material from the chamber when the quantity of developer material therein is greater than a predetermined quantity. Means are provided for discharging toner particles and carrier granules into the chamber of the housing. Means seal the exit port of the housing with a substantially impervious toner particle seal. The sealing means is pervious to developer material and carrier granules so as to prevent the passage of toner particles through the exit port while permitting the passage of developer material and carrier granules therethrough.

In the present invention, there is also provided a method of developing an electrostatic latent image recorded on a photoconductive member employed in an electrophotographic printing machine. The method of developing includes the step of transporting a developer material comprising at least carrier granules and toner particles from a housing storing a supply thereof in a chamber to the surface of the photoconductive member having the electrostatic latent image recorded thereon. Toner particles and carrier granules are discharged into the chamber of the housing. Developer material is removed from the chamber of the housing through an exit port when the quantity of developer material in the chamber is greater than a predetermined quantity. A curtain of at least carrier granules, in the region of the exit port of the housing, prevents the passage of toner particles through the exit port while permitting the passage of developer material and carrier granules therethrough.

Still another aspect of the features of the present invention is an apparatus for developing an electrostatic latent image used in a printing machine including a magnetic developer roller for transporting a developer material comprising at least magnetic carrier granules having toner particles adhering thereto into contact with the electrostatic latent image. A housing defines a chamber having a supply of developer material therein. At least a portion of the magnetic developer roller is located in the chamber of the housing for attracting developer material to the exterior surface thereof. The housing has an exit port for enabling excess developer material to escape from the chamber. Means are provided for discharging toner particles and carrier granules into the chamber of the housing. A magnetic member is mounted on the housing adjacent the exit port therein to generate a magnetic flux field to form a carrier bead curtain over the exit port. The carrier bead curtain prevents the passage of toner particles through the exit port while permitting the passage of developer material and carrier granules therethrough.

Figure 2:
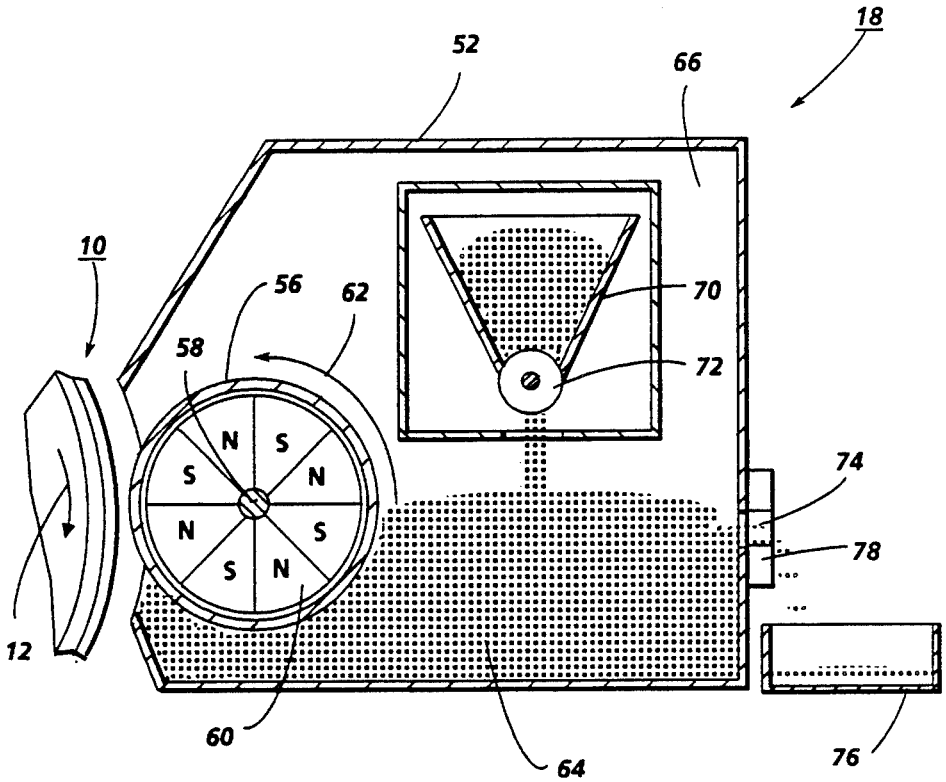

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is a fragmentary, elevational view of the developer unit used in the FIG. 1 printing machine.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine having the developer of the present invention therein. It will become evident from the following discussion that this developer unit is equally well suited for use in a wide variety of printing machines and is not necessarily limited in its application to the particular printing machine described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotograhic printing machine employs a drum 10 having a photoconductive surface adhering to a conductive substrate. Preferably, the photoconductive surface comprises a selenium alloy with the conductive substrate being an electrically grounded aluminum alloy. Drum 10 moves in the direction of arrow 12 to advance successive portions of the photoconductive surface sequentially through the various processing stations disposed about the path of movement thereof.

Initially, a portion of the photoconductive surface passes through charging station A. At charging station A, a corona generating device, indicated generally by the reference numeral 14, charges the photoconductive surface to a relatively high, substantially uniform potential.

Next, the charged portion of the photoconductive surface is advanced through imaging station B. Imaging station B includes an exposure system, indicated generally by the reference numeral 16. Exposure system 16 includes lamps which illuminate an original document positioned face down upon a transparent platen. The light rays reflected from the original document are transmitted through a lens to form a light image thereof. The light image is focused onto the charged portion of the photoconductive surface to selectively dissipate the charge thereon. This records an electrostatic latent image on the photoconductive surface which corresponds to the information in the original document. One skilled in the art will appreciate that in lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam.

After the electrostatic latent image is recorded on the photoconductive surface, drum 10 advances the electrosatic latent image to development station C. At development station C, a magnetic brush developer unit, indicated generally by the reference numeral 18, transports a developer material of magnetic carrier granules having toner particles adhering triboelectrically thereto closely adjacent to, or into contact with the electrostatic latent image. Toner partcles are attracted from the carrier granules to the latent image forming a toner powder image. In the development system, toner particles and a small amount of carrier granules are continually added to the developer material so that the life of the developer material is at least equal to the useful life of the electrophotographic printing machine. Excess developer material exits the developer unit through an exit port which has a toner particle impervious seal. The seal is pervious to carrier granules and developer material. The detailed structure of developer unit 18 will be described hereinafter with reference to FIG. 2.

Drum 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 20. Preferably, sheet feeding apparatus 20 includes a feed roll 22 contacting the uppermost sheet of a stack of sheets 24. Feed roll 22 rotates in the direction of arrow 26 to advance the uppermost sheet into a nip defined by forwarding rollers 28. Forwarding rollers 28 rotate in the direction of arrow 30 to advance the sheet into chute 32. Chute 32 directs the advancing sheet into contact with the photoconductive surface in a timed sequence so that the toner powder image developed thereon contacts the advancing sheet at transfer station D.

Transfer station D includes a corona generating device 34 which sprays ions onto the backside of the sheet. This attracts the toner powder image from the photoconductive surface to the sheet. After transfer, the sheet continues to move in the direction of arrow 36 on conveyor 38 to advance to fusing station E.

Fusing station E includes a fuser assembly, indicated generally by the reference numeral 40, which permanently affixes the transferred toner powder image to the sheet. Preferably, fuser assembly 40 includes a heated fuser roller 42 and a back-up roller 44. The sheet passes between fuser roller 42 and back-up roller 44 with the powder image contacting fuser roller 42. In this manner, the toner powder image is permanently affixed to the sheet. After fusing, forwarding rollers 46 advance the sheet to catch tray 48 for subsequent removal from the printing machine by the operator.

After the powder image is transferred from the photoconductive surface to the copy sheet, drum 10 rotates the photoconductive surface to cleaning station F. At cleaning station F, a cleaning system, indicated generally by the reference numeral 50, removes the residual particles adhering to the photoconductive surface.. In this way, the residual toner particles are removed from the photoconductive surface.

It is believed that the foregoing description is sufficient for purposes of the present invention to illustrate the general operation of an electrophotographic printing machine incorporating the features of the present invention therein.

Referring now to the specific subject matter of the present invention, FIG. 2 illustrates developer unit 18 in greater detail. Developer unit 18 includes a developer housing 52 defining a chamber 54 storing a supply of developer material including carrier granules and toner particles therein. A tubular member or sleeve 56 is mounted rotatably on shaft 58 in chamber 54 of housing 52. An elongated cylindrical magnet 60 is mounted interiorly of sleeve 56. Magnet 60 is mounted stationarily and has a plurality of magnetic poles impressed upon the circumferential surface thereof to generate a magnet field. A motor (not shown) rotates sleeve 56 in the direction of arrow 62. As sleeve 56 rotates in chamber 54 of housing 52, the developer material is attracted thereto. The rotation of sleeve 56 transports the developer material attracted thereto closely adjacent to or into contact with the photoconductive surface. In the development zone, the toner particles are attracted from the carrier granules to the latent image recorded on the photoconductive surface of drum 10. A voltage source electrically biases sleeve 56 to a suitable polarity and magnitude so that the toner particles are deposited on the latent image. Preferably, sleeve 56 is made from aluminum with magnet 60 being made from barium ferrite.

A suppy of developer material 64 is stored in chamber 66 of housing 52. Sleeve 56 is mounted in chamber 66 of housing 52 with a portion thereof extending outwardly through an opening in housing 52 so that the developer material is readily advanced, during the rotation of sleeve 56 in the direction of arrow 62, to the latent image recorded on the photoconductive surface of drum 10. As the electrophotographic printing machine is used, toner particles are depleted therefrom and must be replenished. In addition, the carrier granules age and the entire developer material package, i.e. carrier granules and toner particles, must be periodically replaced in order to maintain the requisite copy quality. In order to solve this problem and be capable of employing a developer material having a useful life at least equal to the usable life of the electrophotographic printing machine, carrier granules are trickled into the developer material. A discharging unit, indicated generally by the referene numeral 68, dispenses a small quantity of carrier granules and the requisite amount of toner particles to developer material 64. Discharging unit 68 is shown as being located in chamber 66 in housing 52. However, one skilled in the art will appreciate that it may be located remotely therefrom as well. Discharging unit 68 includes an open ended hopper 70 having a foam roller 72 positioned in the open end thereof. A mixture of carrier granules and toner particles is stored in hopper 70. As roller 72 rotates, carrier granules and toner particles are discharged from hopper 70 to developer material 64 in chamber 66 of housing 52. The ratio of toner particles to carrier granules by weight being discharged from hopper 70 is substantially greater than the ratio of toner particles to carrier granules by weight in developer material 64. By way of example, the developer material being dispensed from discharging unit 68 may be 25% carrier granules by weight and 75% toner particles by weight with developer material 64 in chamber 66 of housing 52 being about 96% carrier granules by weight and 4% toner particles by weight.

An exit port 74 is located in the side wall of housing 52. As the quantity of developer material 64 exceeds a predetermined amount, i.e. as dictated by the location of exit port 74 in the side wall of housing 52, the extraneous developer material exits chamber 66 via exit port 74 and is discharged to waste container 76. Waste container 76 may be periodically emptied by the machine operator. One skilled in the art will appreciate that, in lieu of an exit port, a stand pipe may be used. The height of the stand pipe determines the amount of developer material in the developer housing chamber with the extraneous developer material being discharged from the bottom opening of the stand pipe to the waste container. A development system of the foregoing type is more fully described in US-A-4,614,165 issued to Folkins et al. on Sept. 30, 1986, the relevant portions thereof being hereby incorporated into the present application. In a system of this type, not only will the developer material and denuded carrier granules exit the chamber of the housing, but toner particles will also exit through the exit port. These toner particles may become airborne and contaminate the other sub assemblies of the printing machine, thereby degrading copy quality. Accordingly, it is necessary to prevent the escape of the toner particles from the chamber of the housing while permitting the exiting of developer material and denuded carrier granules therefrom. This may be achieved by sealing exit port 74 with a toner particle impervious seal. To accomplish this, a magnet 78 is positioned around the periphery of exit port 74. Magnet 78 generates a magnetic flux field in the region of the exit port. The magentic flux field attracts the magnetic carrier granules forming a carrier bead curtain across the opening of exit port 75. The carrier bead curtain permits developer material and denuded carrier granules to pass through the opening in the exit port to exit to waste container 76. However, the carrier bead curtain prevents toner particles from exiting chamber 66 of housing 52 through exit port 74. Thus, the toner particles are confined to chamber 66 of housing 52 while the extraneous developer material and denuded carrier granules are removed therefrom. By way of example, when the exit port is a circular opening, magnet 78 is preferably a ring magnet with its opening aligned with the opening in the exit port. Alternatively, when the exit port is a slot, magnet 78 preferably includes a pair of bar magnets, one bar magnet positioned on either side of the slot. In either case, magnet 78 generates a magnetic flux field which attracts the magnetic carrier granules to form a carrier bead curtain across the opening in exit port 74 which prevents the passage of toner particles therethrough while permitting the passage of developer material and denuded carrier granules.

In recapitulation, the developer unit of the present invention has toner particles and carrier granules added to the developer material therein. Extraneous developer material and denuded carrier granules exit through an exit port which has a carrier bead curtain formed over the opening thereof. The carrier bead curtain permits the passage of developer material and denuded carrier granules through the exit port while preventing the passage of toner particles therethrough. This insures that toner particles do not escape from the developer unit contaminating the other components of the printing machine and degrading copy quality.

It is, therefore, apparent that there has been provided, in accordance with the present invention, a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

I claim:

1. An apparatus for developing an electrostatic latent image used in a printing machine, including:

means for transporting a developer material comprising at least carrier granules having toner particles adhering thereto into contact with the electrostatic latent image;

a housing defining a chamber having a supply of developer material therein, said transporting means being in communication with the chamber of said housing for receiving developer material, said housing having an exit port located at a selected position in the chamber of said housing to enable developer material to exit from the chamber when the level of developer material therein covers at least a portion of the exit port;

means for discharging toner particles and carrier granules into the chamber of said housing; and means for sealing the exit port of said housing with a substantially impervious toner particle seal, said sealing means being previous to developer material and carrier granules so as to prevent the passage of toner particles through the exit port while permitting the passage of developer material and carrier granules therethrough to maintain a predetermined quantity of developer material and carrier granules in the chamber of said housing.

2. An apparatus according to claim 1, wherein said sealing means includes means for generating a magnetic flux field in the region of the exit port of said housing to form a carrier bead curtain which prevents the passage of toner particles through the exit port while permitting the passage of developer material and carrier granules therethrough.

3. An apparatus according to claim 2, wherein the ratio of toner particles to carrier granules by weight being added by said discharging means to the chamber of the housing is substantially greater than the ratio of toner particles to carrier granules by weight in the chamber of said housing.

4. An apparatus according to claim 3, wherein said generating means includes a magnetic member positioned adjacent the exit port of said housing.

5. An apparatus according to claim 4, wherein said discharging means includes means for storing a supply of carrier granules and toner particles.

6. An electorphotograhic printing machine of the type having an electrostatic latent image recorded on a photoconductive member, wherein the improvement includes:

means for transporting a developer material comprising at least carrier granules having toner particles adhering thereto closely adjacent to the electrostatic latent image recorded on the photoconductive member;

a housing defining a chamber having a supply of developer material therein, said transporting means being in communication with the chamber of said housing for receiving developer material, said housing having an exit port located at a selected position in the chamber of said housing to enable developer material to exit from the chamber when the level of developer material therein covers at least a portion ofthe exit port;

means for discharging toner particles and carrier granules into the chamber of said housing; and means for sealing the exit port of said housing with a substantially impervious toner particle seal, said sealing means being previous to developer material and carrier granules so as to prevent the passage of toner particles through the exit port while permitting the passage of developer material and carrier granules therethrough to maintain a predetermined quantity of developer material and carrier granules in the chamber of said housing.

7. A printing machine according to claim 6, wherein said sealing means includes means for generating a magnetic flux field in the region of the exit port of said housing to form a carrier bead curtain which prevents the passage of toner particles through the exit port while permitting the passage of developer material and carrier granules therethrough.

8. A printing machine according to claim 7, wherein the ratio of toner particles to carrier granules by weight being added by said discharging means to the chamber of the housing is substantially greater than the ratio of toner particles to carrier granules by weight in the chamber of said housing.

9. A printing machine according to claim 8, wherein said generating means includes a magnetic member positioned adjacent the exit port of said housing.

10. A printing machine according to claim 9, wherein said discharging means includes means for storing a supply of carrier granules and toner particles.

11. An apparatus for developing an electrostatic latent image used in a printing machine, including:

a magnetic developer roller for transporting a developer material comprising at least magnetic carrier granules having toner particles adhering thereto into contact with the electrostatic latent image;

a housing defining a chamber having a supply of developer material therein with at least a portion of said magnetic developer roller being located in the chamber of said housing for attracting developer material to the exterior surface thereof, said housing having an exit port located at a selected position in the chamber of said housing for enabling excessive developer material to escape from the chamber when the level of developer material therein covers at least a portion of the exit port;

means for discharging toner particles and carrier granules into the chamber of said housing; and a magnetic member mounted on said housing adjacent the exit port therein to generate a magnetic flux field to form a carrier bead curtain over the exit port which prevents the passage of toner particles through the exit port while permitting the passage of developer material and carrier granules therethrough to maintain a predetermined quantity of developer material and carrier granules in the chamber of said housing.

* * * * *